US011517505B2

(12) United States Patent
Creaturo

(10) Patent No.: US 11,517,505 B2
(45) Date of Patent: Dec. 6, 2022

(54) INTEGRATED CONTAINER AND DOSING DEVICE FOR LIQUID MEDICATION DELIVERY

(71) Applicant: Parenteral Technologies, LLC, Siesta Key, FL (US)

(72) Inventor: Michael A. Creaturo, Siesta Key, FL (US)

(73) Assignee: Parenteral Technologies, LLC, Siesta Key, FL (US)

( * ) Notice: Subject to any disclaimer, the term of this patent is extended or adjusted under 35 U.S.C. 154(b) by 388 days.

(21) Appl. No.: 16/722,486

(22) Filed: Dec. 20, 2019

(65) Prior Publication Data

US 2020/0197260 A1 Jun. 25, 2020

Related U.S. Application Data

(60) Provisional application No. 62/782,831, filed on Dec. 20, 2018.

(51) Int. Cl.
*A61J 1/20* (2006.01)
*A61J 1/14* (2006.01)
(Continued)

(52) U.S. Cl.
CPC ..... *A61J 1/2037* (2015.05); *A61J 1/1418* (2015.05); *A61J 1/1481* (2015.05); *A61J 1/18* (2013.01); *A61J 2205/00* (2013.01); *B65D 47/06* (2013.01)

(58) Field of Classification Search
CPC ..... G01F 11/262; G01F 19/00; B65D 47/06–185; B65D 7/005; A61J 1/2037;
(Continued)

(56) References Cited

U.S. PATENT DOCUMENTS 844,686 A * 2/1907 Marschall ..... G01F 19/00 222/425
2,768,660 A * 10/1956 Russell ..... G01F 11/262 141/319

(Continued)

FOREIGN PATENT DOCUMENTS

FR 2915971 A1 * 11/2008 ..... G01F 11/262

OTHER PUBLICATIONS

International Search Report for International Application No. PCT/US19/67792 dated Mar. 25, 2020.

*Primary Examiner* — Andrew D StClair
(74) *Attorney, Agent, or Firm* — Suiter Swantz pc llo

(57) ABSTRACT

A medication delivery apparatus including a container and a paired delivery device removably attached to the container, wherein a fluid passageway between the container and the delivery device permits fluid medication to be transferred from the container to the delivery device to then be dispensed from the delivery device. The delivery device is rotatable between first and second operative positions with respect to the container, the first operative position for filling the delivery device with a predetermined dosage of a liquid medication and the second operative position for dispensing the predetermined dosage from the delivery device. The first and second operative positions of the delivery device may correspond with respective inverted and upright positions of the container.

17 Claims, 16 Drawing Sheets

(51) Int. Cl.
*A61J 1/18* (2006.01)
*B65D 47/06* (2006.01)

(58) Field of Classification Search
CPC ..... A61J 1/1418; A61J 1/1481; A61J 1/18; A61J 2205/00; B67D 7/005
See application file for complete search history.

(56) References Cited

U.S. PATENT DOCUMENTS 4,079,859 A * 3/1978 Jennings ..... G01F 11/262 222/1
4,214,679 A 7/1980 Whang
4,865,230 A * 9/1989 Tugwood ..... B05B 11/3015 222/536
5,020,699 A 6/1991 Sams
5,271,538 A * 12/1993 Lipker ..... B65D 47/065 222/536
5,337,926 A 8/1994 Drobish et al.
6,378,735 B1 * 4/2002 Chu ..... B65D 83/06 222/548
7,025,232 B2 * 4/2006 Green ..... B05B 11/0091 222/533
2001/0050242 A1 * 12/2001 Kaplan ..... A61J 1/00 206/459.1
2006/0163187 A1 7/2006 Kopinetz
2008/0149638 A1 6/2008 Van Hees et al.
2009/0143745 A1 * 6/2009 Langan ..... A61M 5/31 604/404
2012/0000592 A1 * 1/2012 Mase ..... G09F 3/10 40/310
2013/0204225 A1 * 8/2013 Creaturo ..... A61M 5/31511 604/189

* cited by examiner

INTEGRATED CONTAINER AND DOSING DEVICE FOR LIQUID MEDICATION DELIVERY

BACKGROUND

Liquid medications such as children's oral medications are typically packaged as a two-part system including a medication container and separate dosing device. Dosing devices may take the form of a syringe, dropper, spoon, cup, etc. While the two components may be intended for use together, their physical detachment makes their use cumbersome and prone to separation, particularly after the initial use. Because not all dosing devices are compatible for use with all medication containers, separation and loss of a dosing device can lead to a user dosing with an incompatible device, potentially resulting in underdosing or overdosing situations that can be dangerous and negatively impact the efficacy of the medication.

In addition, conventional medication containers and dosing devices are marked with minimal information in terms of the medication compatible for use with the device, terms of use, dosing instructions, etc., further contributing to dosing errors such as underdosing or overdosing.

Accordingly, what is needed is a comprehensive, integrated drug delivery solution that overcomes the disadvantages of prior art systems, and more particularly, a solution in which the medication container and paired delivery device are physically coupled in an easy-to-use and intuitive design marked with all pertinent information necessary to ensure accurate dosing.

BRIEF SUMMARY

To achieve the foregoing and other aspects, in a first embodiment the present invention provides a medication delivery apparatus including a container configured to contain liquid medication, a delivery device rotatably attached and coupled in fluid communication to the container, the delivery device paired for use with the container, and a fluid passageway extending between the container and the delivery device, wherein, in a first operative position of the delivery device with respect to the container liquid medication is transferable from the container to the delivery device through the fluid passageway, and in a second operative position of the delivery device with respect to the container liquid medication is dispensable from the delivery device.

In some embodiments, the delivery device may rotate with respect to the container between the first and second operative positions of the delivery device.

In some embodiments, the apparatus may further include a child-proof cap removably attached to the container, the child-proof cap rotatable relative to the container between a first position closing the fluid passageway and a second position opening the fluid passageway.

In some embodiments, the apparatus may further include a check valve disposed in the fluid passageway permitting liquid medication flow in a direction of the delivery device and preventing liquid medication flow in a direction of the container.

In some embodiments, the first operative position of the delivery device may correspond to an inverted orientation of the container and the second operative position of the delivery device may correspond to an upright orientation of the container.

In some embodiments, the apparatus may further include a coupling element coupling the delivery device to the container, the coupling element defining at least a portion of the fluid passageway therethrough and having spaced first and second stops, wherein the delivery device is rotationally constrained between the spaced first and second stops, and wherein positioning the delivery proximate the first stop positions the delivery device in the first operative position and positioning the delivery device proximate the second stop positions the delivery device in the second operative position.

In some embodiments, the coupling element may include a first fluid flow passageway therethrough and a second fluid flow passageway therethrough, wherein the first fluid flow passageway is diametrically larger than the second fluid flow passageway, and wherein the delivery device is aligned with the first fluid flow passageway in the first operative position of the delivery device to permit liquid medication flow from the container to the delivery device, and the delivery device is aligned with the second fluid flow passageway in the second operative position of the delivery device to permit air to flow from the container to the delivery device to dispense liquid medication from the delivery device.

In some embodiments, at least one of the container and the delivery device may be marked with a name of a liquid medication contained in the container, a concentration or potency of the liquid medication contained in the container, and at least one set of dosage indicia for dosing a liquid medication according to a manufacturer's recommended dosage.

In some embodiments, the delivery device may be marked with a first set of dosing indicia expressed in a dosage unit of measurement matching a dosage unit of measurement of a concentration of liquid medication in the container, and a second set of dosing indicia expressed as a patient characteristic, and wherein the dosing indicia are expressed as one or more of mL, mg, mcg, IU, $m^2$, age, weight, temperature, or a maximum or a minimum of any one of mL, mg, mcg, IU, $m^2$, age, weight and temperature.

In some embodiments, the apparatus may include a pump sprayer for pumping liquid medication from the container to the delivery device and/or dispensing liquid medication from the delivery device, the pump sprayer configured to direct fluid medication through the fluid passageway when the container is inverted and air through the fluid passageway when the container is upright.

In some embodiments, the delivery device may be in the form of a syringe, a spoon, a barrel, a pipette, a dropper or a cup.

In another embodiment, the present invention provides a medication delivery apparatus including a container containing liquid medication, a delivery device removably attached to the container, and a fluid passageway extending between the container and the delivery device, wherein, in a first operative position of the medication delivery apparatus the liquid medication is transferable from the container to the delivery device through the fluid passageway, and in a second operative position of the medication delivery apparatus the liquid medication is dispensable from the delivery device.

In some embodiments, the apparatus may include a child-proof cap removably attached to the container, the child-proof cap rotatable with respect to the container between a first position closing the fluid passageway and a second position opening the fluid passageway.

In some embodiments, the apparatus may include a check valve disposed in the fluid passageway allowing liquid medication flow in a direction of the delivery device and preventing liquid medication from in a direction of the container.

In some embodiments, the first operative position of the medication delivery apparatus may correspond to an inverted orientation of the container and/or a first rotational position of the delivery device, and the second operative position of the medication delivery apparatus may correspond to an upright orientation of the container and/or a second rotational position of the delivery device.

In some embodiments, the apparatus may include a coupling element coupling the delivery device to the container, the coupling element defining at least a portion of the fluid passageway therethrough and having spaced first and second stops, the delivery device rotationally constrained between the spaced first and second stops, and wherein positioning the delivery proximate the first stop positions the delivery device in the first operative position and positioning the delivery device proximate the second stop positions the delivery device in the second operative position, the coupling element including a first fluid flow passageway therethrough and a second fluid flow passageway therethrough, wherein the first fluid flow passageway is diametrically larger than the second fluid flow passageway, and wherein the delivery device is aligned with the first fluid flow passageway in the first operative position of the delivery device to permit the liquid medication to flow from the container to the delivery device, and the delivery device is aligned with the second fluid flow passageway in the second operative position of the delivery device to permit air to flow from the container to the delivery device to dispense the liquid medication from the delivery device.

In some embodiments, at least one of the container and the delivery device may be marked with a name of the liquid medication contained in the container and a concentration or potency of the liquid medication contained in the container, and wherein the delivery apparatus is marked with at least one set of dosage indicia for dosing the liquid medication according to a manufacturer's recommended dosage.

In another embodiment, the present invention provides a medication delivery apparatus including a container, a delivery device removably attached to the container, and a fluid passageway extending between the container and the delivery device, wherein, when the delivery device is attached to the container, fluid is transferable from the container to the delivery device through the fluid passageway, and wherein fluid is dispensable from the delivery device when the delivery device is attached to the container or detached from the container.

In some embodiments, at least one of the container and the delivery device may be required to be positioned in a first orientation to transfer fluid from the container to the delivery device, and may be required to be in a second orientation different from the first to dispense fluid from the delivery device.

In some embodiments, the apparatus may include a cap attached to the container, the cap rotatable relative to the container between a first position closing the fluid passageway and a second position opening the fluid passageway.

Embodiments disclosed herein may include one or more or any combination of the above features and aspects.

BRIEF DESCRIPTION OF THE DRAWINGS

Implementations of the embodiments disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Embodiments of the invention are described hereinafter with reference to the accompanying drawings in which non-limiting examples are shown. Embodiments of the invention are generally directed to medication delivery apparatus including a medication container configured to contain a volume of liquid medication and a delivery device physically connected and fluidly coupled to the container such that the liquid medication can be transferred from the container to the delivery device. Once a predetermined dose is transferred to the delivery device, the medication can be administered to a patient via the delivery device through the flow of gravity or from evacuation force from the medication container. The apparatus may include a check valve or other flow-control mechanism to prevent backflow from the delivery device into the container. The container may contain a volume of liquid medication greater than a maximum volume of the delivery device such that the apparatus can be used to administer multiple doses. The delivery device may be permanently attached to the container or may be removably attached to facilitate removal for cleaning.

Figure 1:
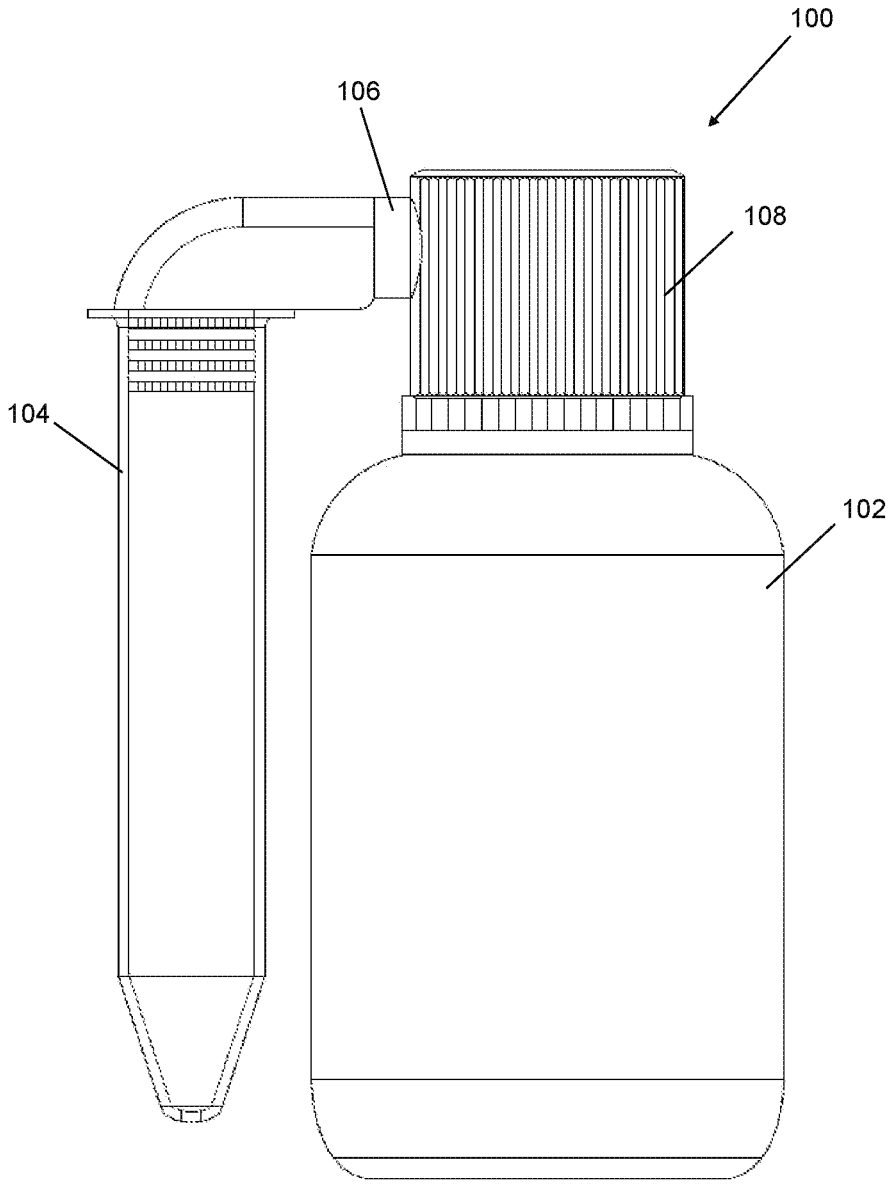
FIG. 1 shows a medication delivery apparatus according to an embodiment of the invention.

FIG. 1 illustrates a non-limiting example of a medication delivery apparatus 100 including a container 102 configured to contain liquid medication and a delivery device 104 rotatably attached and coupled in fluid communication to the container 102. The delivery device 104 is paired for use with the container 102 and the liquid medication contained therein. A fluid passageway extends between the container 102 and the delivery device 104 such that liquid medication can be transferred from the container to the delivery device for administration to a patient. In other words, the container 102 serves to store an amount of predetermined liquid medication to be administered using the delivery device 104 physically attached to the container. The two are coupled in fluid communication such that the delivery device can be filled with a dosage of liquid medication while the two remain attached. The fluid passageway from the container to the delivery device allows the fluid medication to the transferred into the delivery device, for example, by the flow of gravity, from evacuation pressure from user activation such as squeezing the container, via a pump sprayer, via an actuator, etc.

The delivery device 104 may be rotatably coupled to the container 102 such that the delivery device can be rotated to open and close the fluid passageway and/or for filling the delivery device or for dispensing liquid medication from the delivery device. In one example, in a first operative position of the delivery device 104 with respect to the container 102, liquid medication can be transferred from the container to the delivery device through the fluid passageway and is prevented from being dispensed from the delivery device, and in a second operative position of the delivery device 104 with respect to the container 102, liquid medication can be dispensed from the delivery device and is prevented from being transferred from the delivery device to the container through the fluid passageway.

As described further below, the delivery device 104 may have various forms and may be marked with dosage indicia corresponding to recommended dosages for the predetermined medication. As shown in FIG. 1, the dosage indicia are provided in the volumetric dosage unit of mL as a non-limiting example, and the markings are graduated such that filling occurs from the attached end of the delivery device toward its dispensing end. Dosages may be adjusted or metered as described further below.

The delivery device 104 may be coupled to the container 102 through a coupling element 106 defining and/or controlling at least a portion of flow through the fluid passageway. A cap 108, such as a child-proof cap, may be removably attached to the container 102 and may rotate between a first position closing the fluid passageway and a second position opening the fluid passageway. The container 102 may be a resiliently deformable plastic bottle or the like. At least one of the container 102 and the delivery device 104 may be marked with the name of the predetermined medication, concentration of the predetermined medication, potency of the predetermined medication, manufacturer's recommended dosages for the predetermined medication, dosage schedules for the predetermined medication, among other markings and information.

Figure 2:
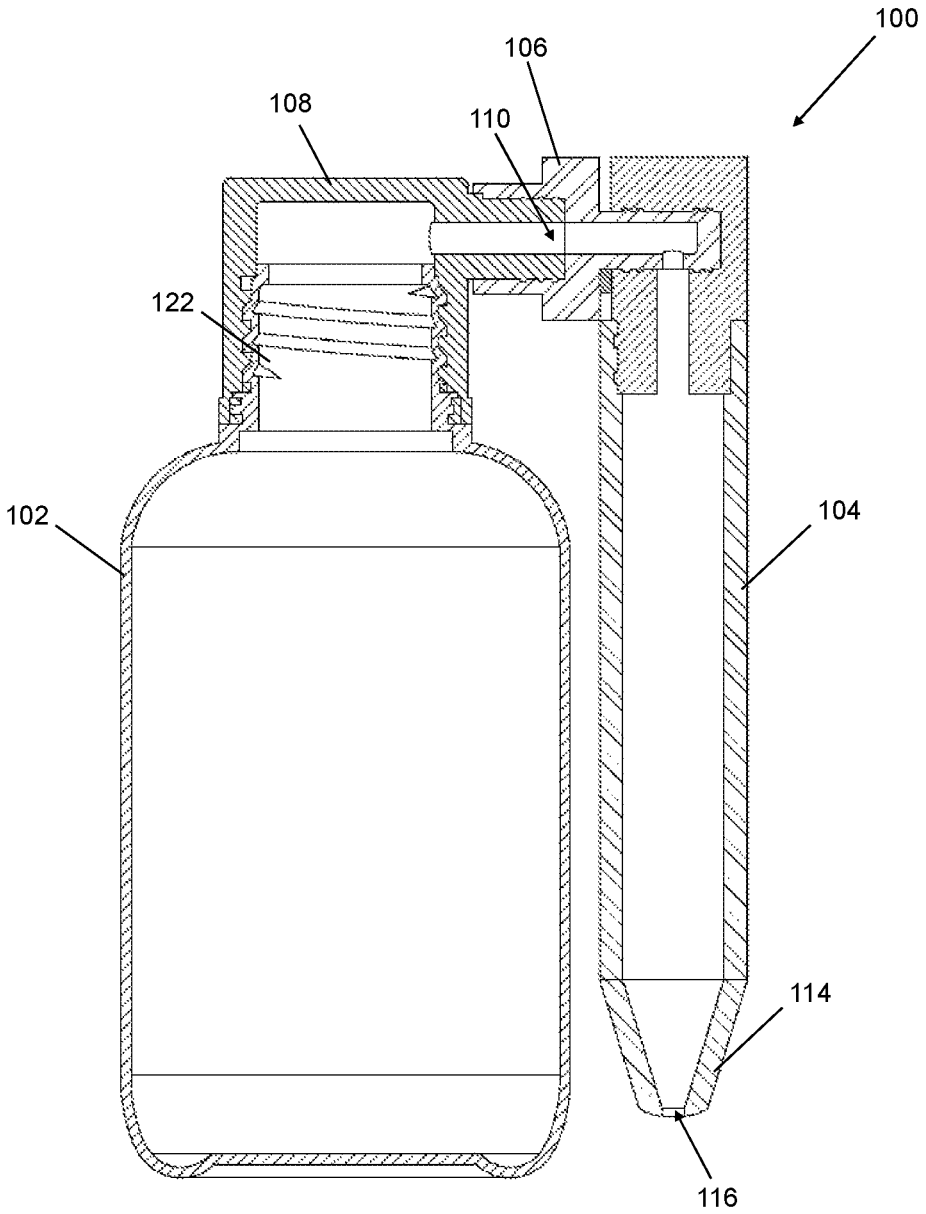
FIG. 2 is a longitudinal cross-section through the medication delivery apparatus of FIG. 1.

FIG. 2 shows the physical attachment and fluid coupling of the delivery device 104 and container 102. The fluid passageway 110 extends from or between the container 102 and the delivery device 104 such that fluid (e.g., air or liquid medication) can be transferred in at least one direction. The container 102 may include an externally threaded neck 112 for engaging the internally threaded removable cap 108, which can be a child-proof cap. In one embodiment, a neck opening may align with a cap opening to open and close the fluid passageway. In another embodiment, fluid may pass through the top of the container and the cap 108 serves to control opening and closing the fluid passageway from the container end.

As shown in FIG. 2, a portion of the fluid passageway 110 may be defined by the cap 108 and a further portion of the fluid passageway defined by the coupling element 106. The coupling element 106 may be rotatably coupled to the cap 108 by press-fit engagement or the like. The delivery device 104 may be rotatably coupled to one end of the coupling element 106 by press-fit engagement or the like such that the rotation axis of the delivery device 104 is perpendicular to the delivery device longitudinal axis. The dispensing end 114 of the delivery device 104 is located opposite its rotatably coupled end and dispensing may occur through an opening 116 in the dispensing end.

Figure 3:
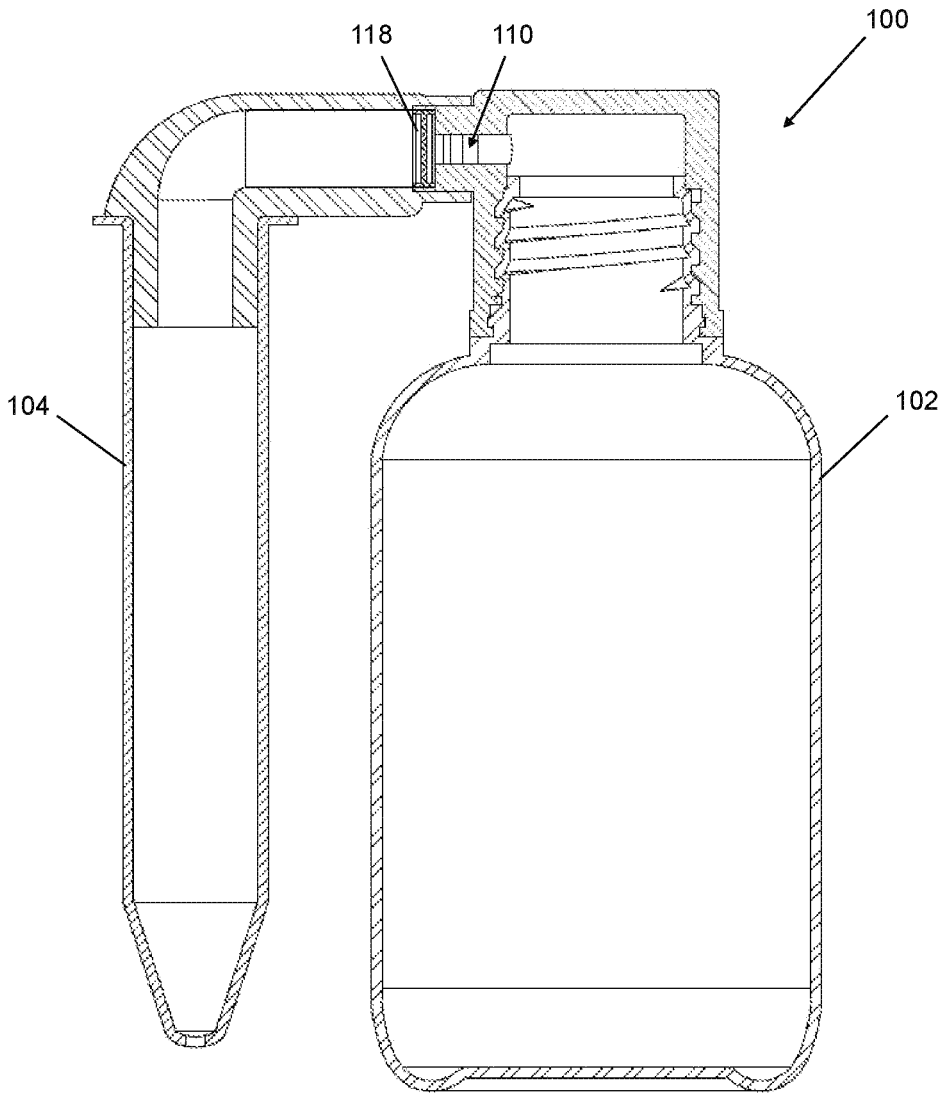
FIG. 3 is a partial cross-section through another embodiment of a medication delivery apparatus.

FIG. 3 shows an embodiment of the medication delivery apparatus 100 including a check valve 118 disposed in the fluid passageway for allowing fluid to flow in the direction from the container 102 to the delivery device 104 while preventing fluid flow from the delivery device back into the container. Non-limiting examples of check valves include diaphragm check valves, flapper valves, duckbill valves and the like.

Figure 4:
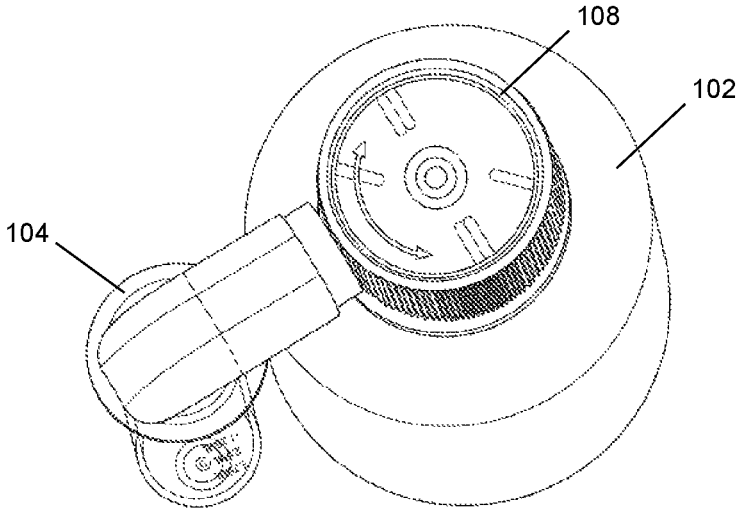
FIG. 4 is a top view of the medication delivery apparatus of FIG. 3.
Figure 5:
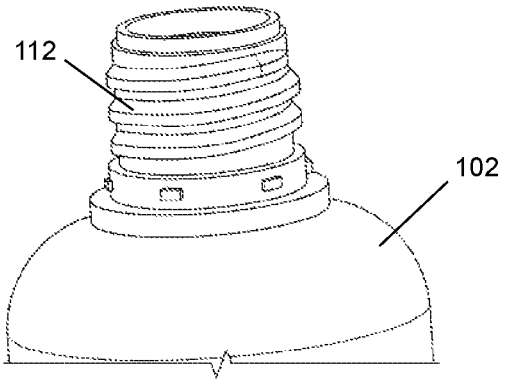
FIG. 5 is a fragmentary perspective view of a threaded container neck.
Figure 6:
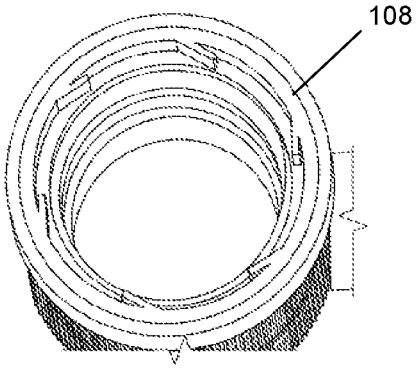
FIG. 6 is a bottom view of a child-proof cap.

FIG. 4 shows cap rotation functionality to open and close the fluid passageway. For example, the cap 108 may rotate between a first operative position in which the fluid passageway is closed preventing fluid flow into or out of the container 102, and a second operative position in which the fluid passageway is open allowing fluid flow into or out of the container. Opening and closing the fluid passageway may be achieved by respectively aligning and misaligning openings or passages in the neck and cap. FIG. 5 shows a non-limiting example of an externally threaded neck 112 of the container 102. FIG. 6 shows a non-limiting example of a child-proof or safety cap 108 requiring a specific manipulation to permit rotation. For example, rotation may require pressing down on the cap to clear a container feature before the cap can be rotated, diametrically distorting the cap to clear a rotation prevention feature on the container, or any other type of conventional safety cap configuration.

Figure 7:
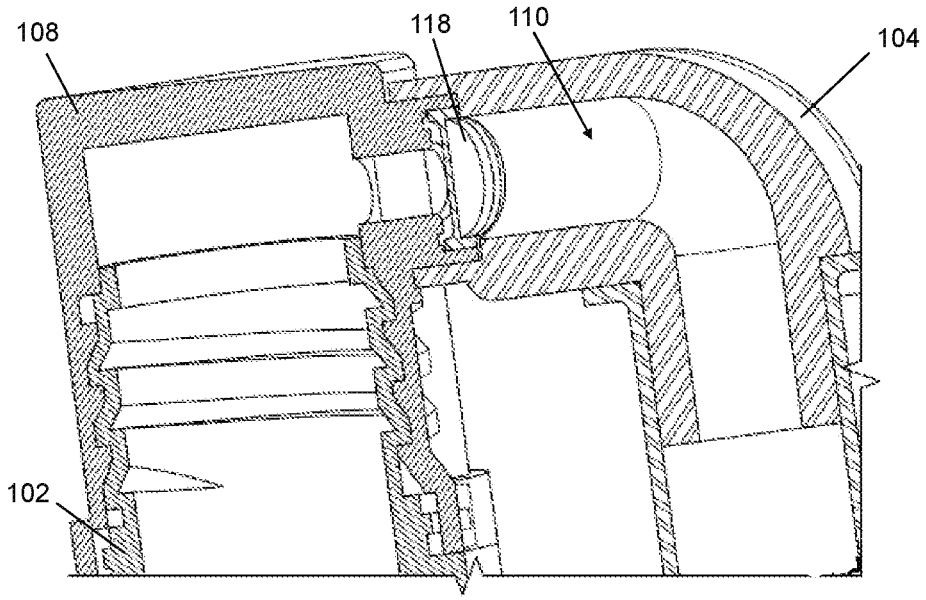
FIG. 7 is a fragmentary cross-section of one embodiment of the medication delivery apparatus.
Figure 8:
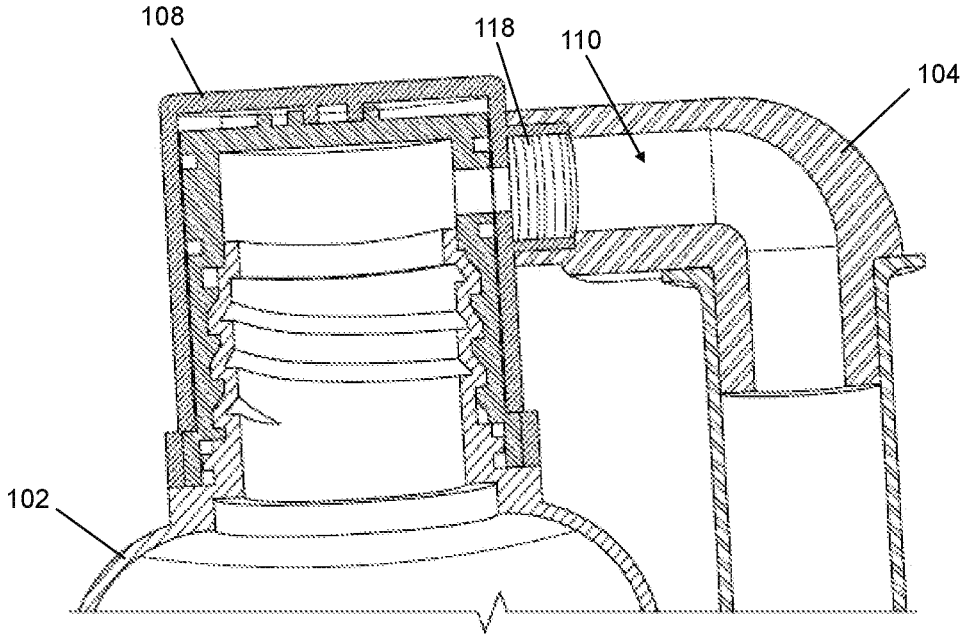
FIG. 8 is a fragmentary cross-section of one embodiment of the medication delivery apparatus.
Figure 9:
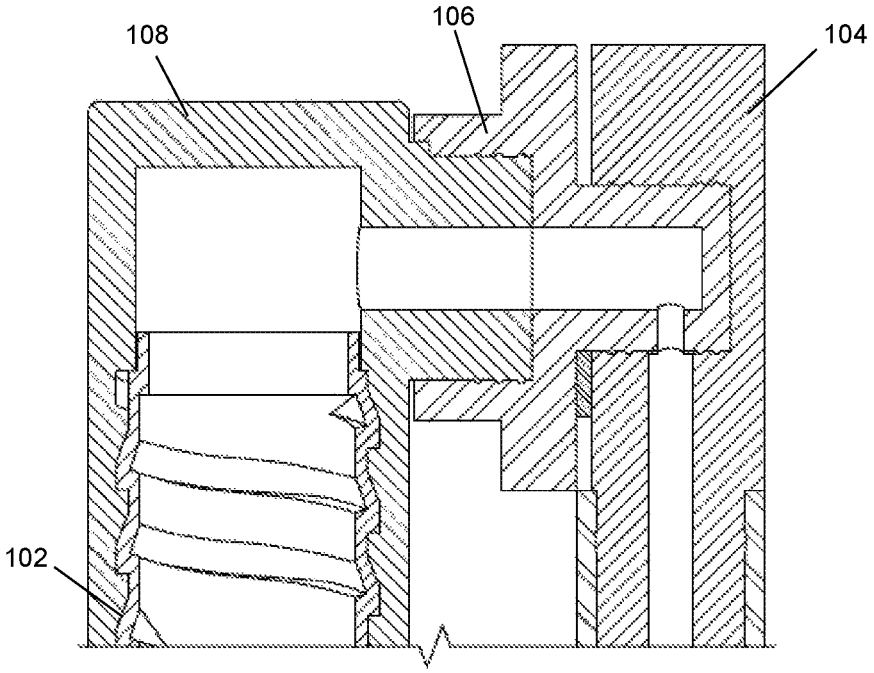
FIG. 9 is a fragmentary cross-section of one embodiment of the medication delivery apparatus.

FIGS. 7-9 shows different delivery device 104 and container 102 attachment and fluid coupling configurations with check valves 112 wherein the cap 108 functions to attach the delivery device and rotate to open and close the fluid passageway 110 or a the cap and delivery device are coupling through an intermediate coupling element 106.

Figure 10:
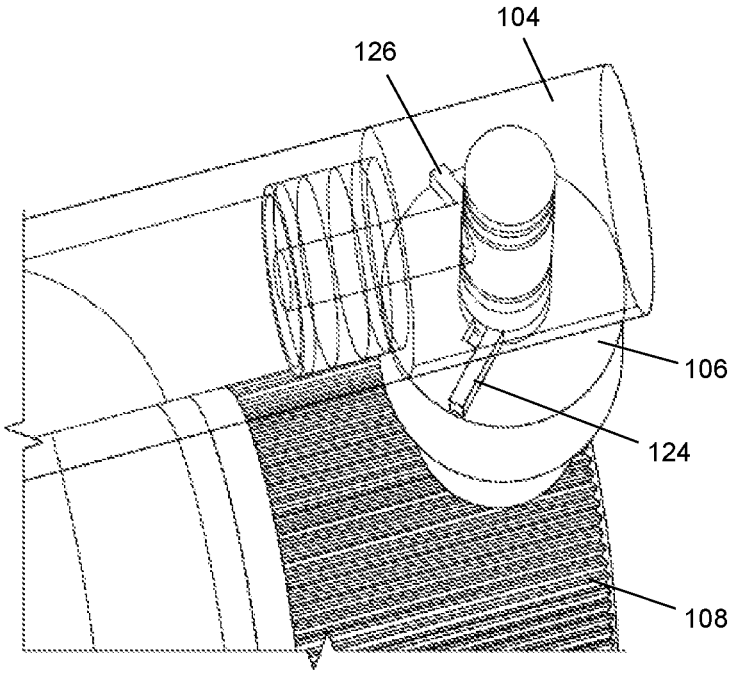
FIG. 10 is a fragmentary perspective view detailing a coupling element.
Figure 11:
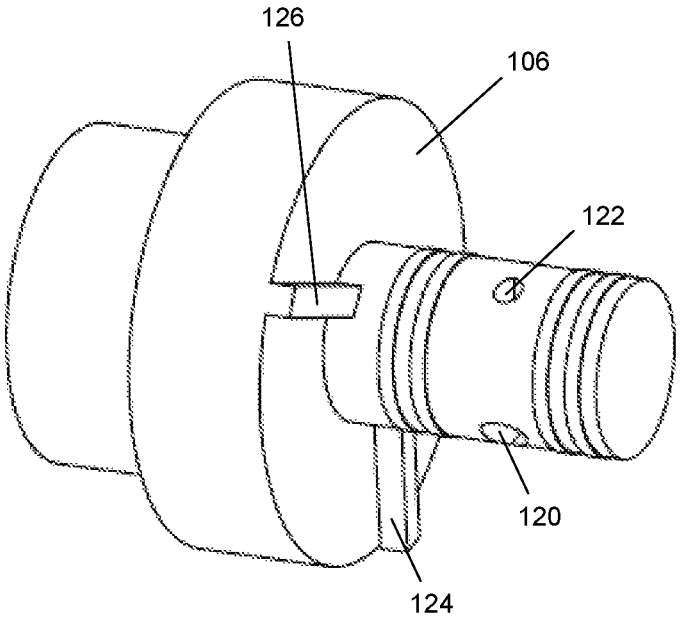
FIG. 11 is an isometric view of a coupling element.

FIGS. 10 and 11 show a non-limiting example of the coupling element 106. The coupling element 106 may rotatably attach at one end to the cap 108 and at the opposing end rotatably attach the delivery device 104. The coupling element 106 may include a fluid passageway therethrough having a first portion formed extending axially along the coupling element and at least one second portion formed extending perpendicular to the axial portion. As shown, the coupling element 106 forms two second portions 120, 122. One of the two second portions 120, 122 may be diametrically larger than the other, with the larger diameter sized to allow liquid to flow therethrough and the smaller diameter sized to allow air to flow therethrough while restricting fluid flow. In this regard, The delivery device can be rotated into fluid passageway alignment with the larger opening to pass liquid medication from the container to the delivery device and the delivery device can be rotated into fluid passageway alignment with the smaller opening to pass air into the delivery device from the container to, for example, evacuate the liquid medication from the delivery device using the force of air from the container.

Figure 12:
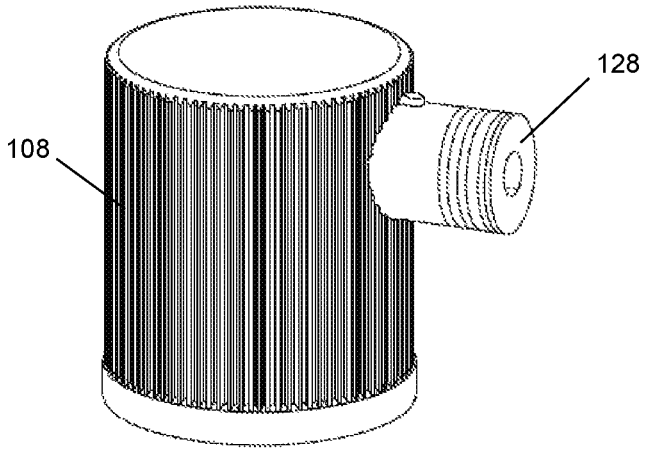
FIG. 12 is an isometric view of a container cap.

The coupling element 106 may further include spaced first and second stops 124, 126 for rotationally constraining the delivery device with respect to the coupling element. In the non-limiting example shown, the first and second stops 124, 126 in the form of shoulders may be provided on a face of the coupling element in spaced-apart relation facing the delivery device. When assembled, the delivery device 104 is installed between the first and second stops 124, 126 and the two stops limit rotation of the delivery device with respect to the coupling element. In use, the delivery device 104 is rotated into position against the first stop 124 to align the larger opening 120 through the coupling element 106 with the fluid passageway of the delivery device to allow liquid to be passed into the delivery device, and the delivery device is rotated into position against the second stop 126 to align the smaller opening 122 through the coupling element 106 with the fluid passageway of the delivery device to allow air to be passed into the delivery device. Thus, the openings 120, 122 and stops 124, 126 correspond to first and second operative positions of the delivery device 104. FIG. 12 shows a cap extension 128 to which the coupling element 106 may attach.

Figure 13:
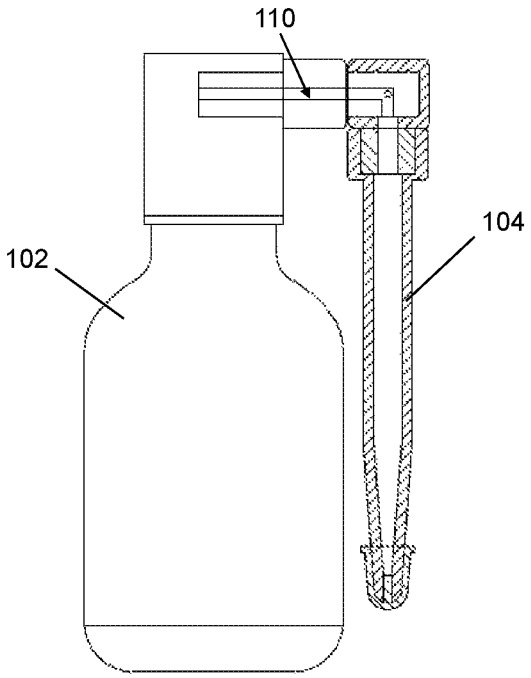
FIG. 13 is a partial cross-section of the apparatus with the container upright.
Figure 14:
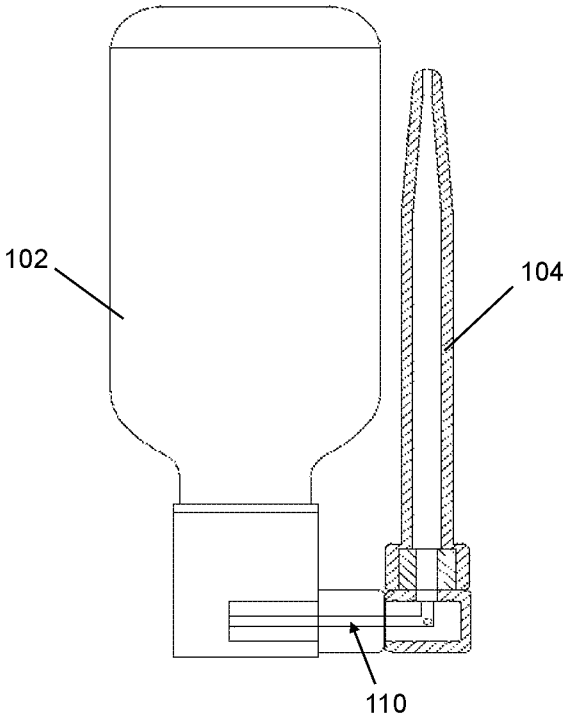
FIG. 14 is a partial cross-section of the apparatus with the container inverted.

FIGS. 13 and 14 show container orientations that correspond dispensing liquid medication from the delivery device and filling the delivery device. FIG. 13 shows the container 102 upright for dispensing the liquid medication from the delivery device 104. When the container 102 is upright, liquid medication within the container falls below the entrance to the fluid passageway 110 in the container and no liquid can enter the fluid passageway. Squeezing, for example, the resiliently deformable container in this orientation evacuates air from within the container thereby forcing the evacuating air through the fluid passageway 110 and into the delivery device whereby the force of the evacuating air dispenses the liquid medication from the delivery device. FIG. 14 shows the container 102 inverted (i.e., turned upside down) for filling the delivery device 104 with a predetermine volume of liquid medication. When the container 102 is inverted, liquid medication within the container falls to the level of the entrance to the fluid passageway 110 in the container and liquid can enter the fluid passageway. Squeezing, for example, the resiliently deformable container in this orientation evacuates liquid medication from within the container thereby forcing the evacuating liquid medication through the fluid passageway 110 and into the delivery device.

Figure 15:
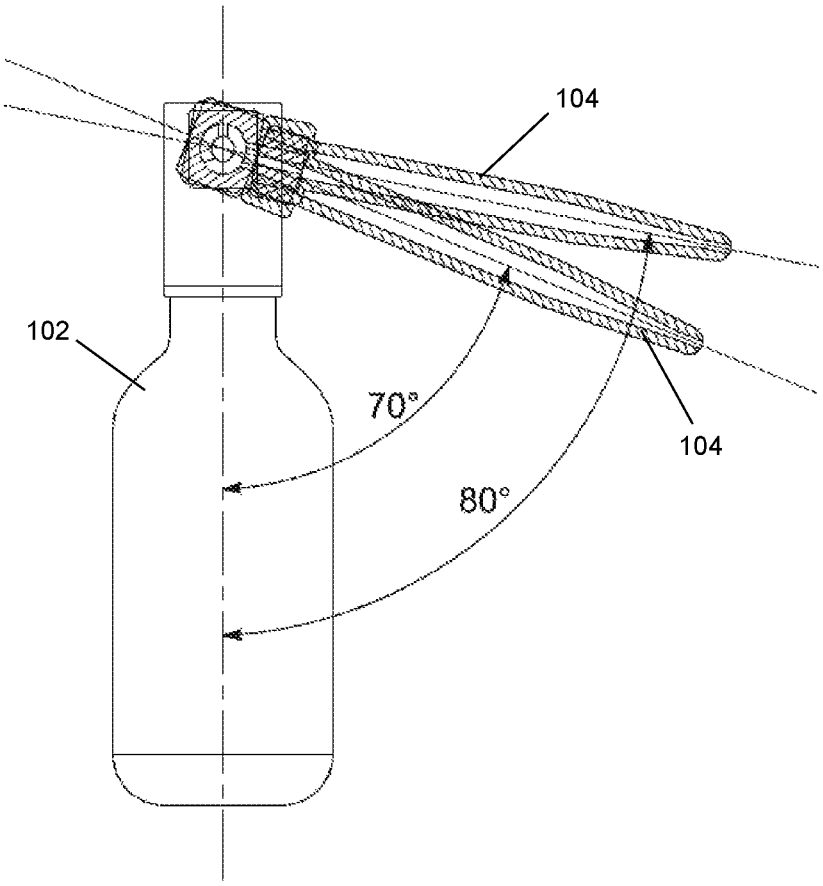
FIG. 15 is a partial cross-section of the apparatus showing first and second operative positions of the delivery device.

FIG. 15 shows first and second non-limiting operative positions of the delivery device 104 with respect to the container 102. In use, the first and second operative positions of the delivery device 104, which are selected by rotating the delivery device into position, may correspond to operative states of the apparatus. For example, to fill the delivery device 104 the container 102 may be held inverted and the delivery device positioned longitudinally parallel with the container, and to dispense the liquid medication the container may be held upright and the delivery device rotated to a predetermined angle with respect to the container, wherein a first position corresponds to an open fluid passageway position and the second position corresponds to a closed fluid passageway position. A non-limiting example of a difference between the angular positions is shown in FIG. 15, wherein the angular positions are optimized for ergonomics in dispensing with the delivery device pointing slightly down.

Figure 16A:
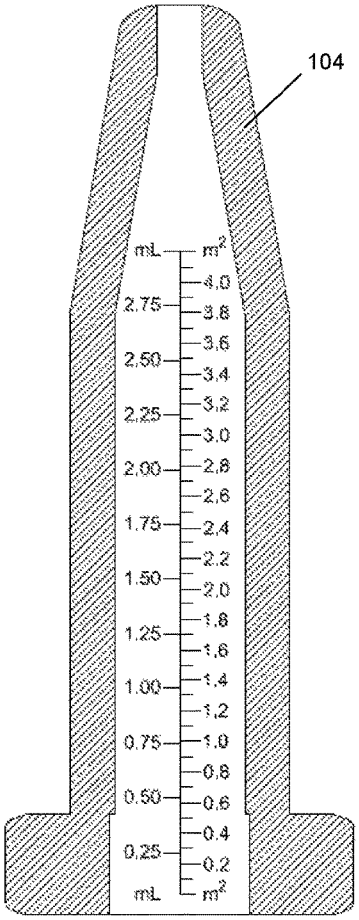
FIGS. 16A-C are cross-sections of embodiments of marked delivery devices.
Figure 16B:
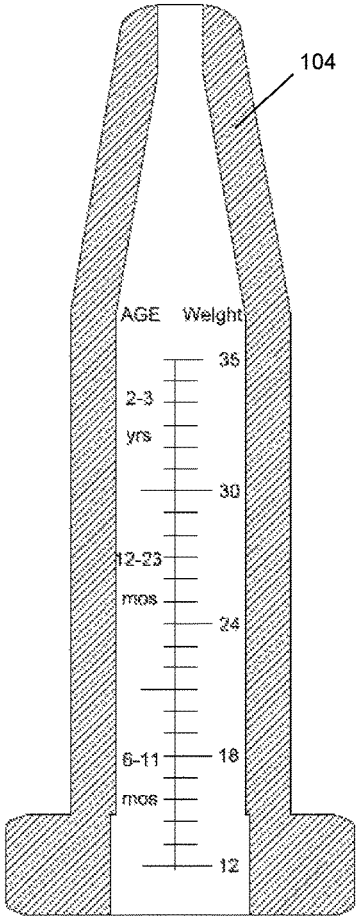
Figure 16C:
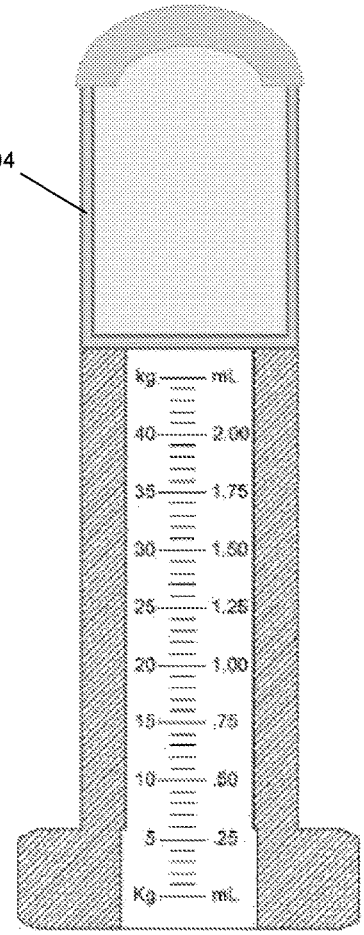
Figure 17A:
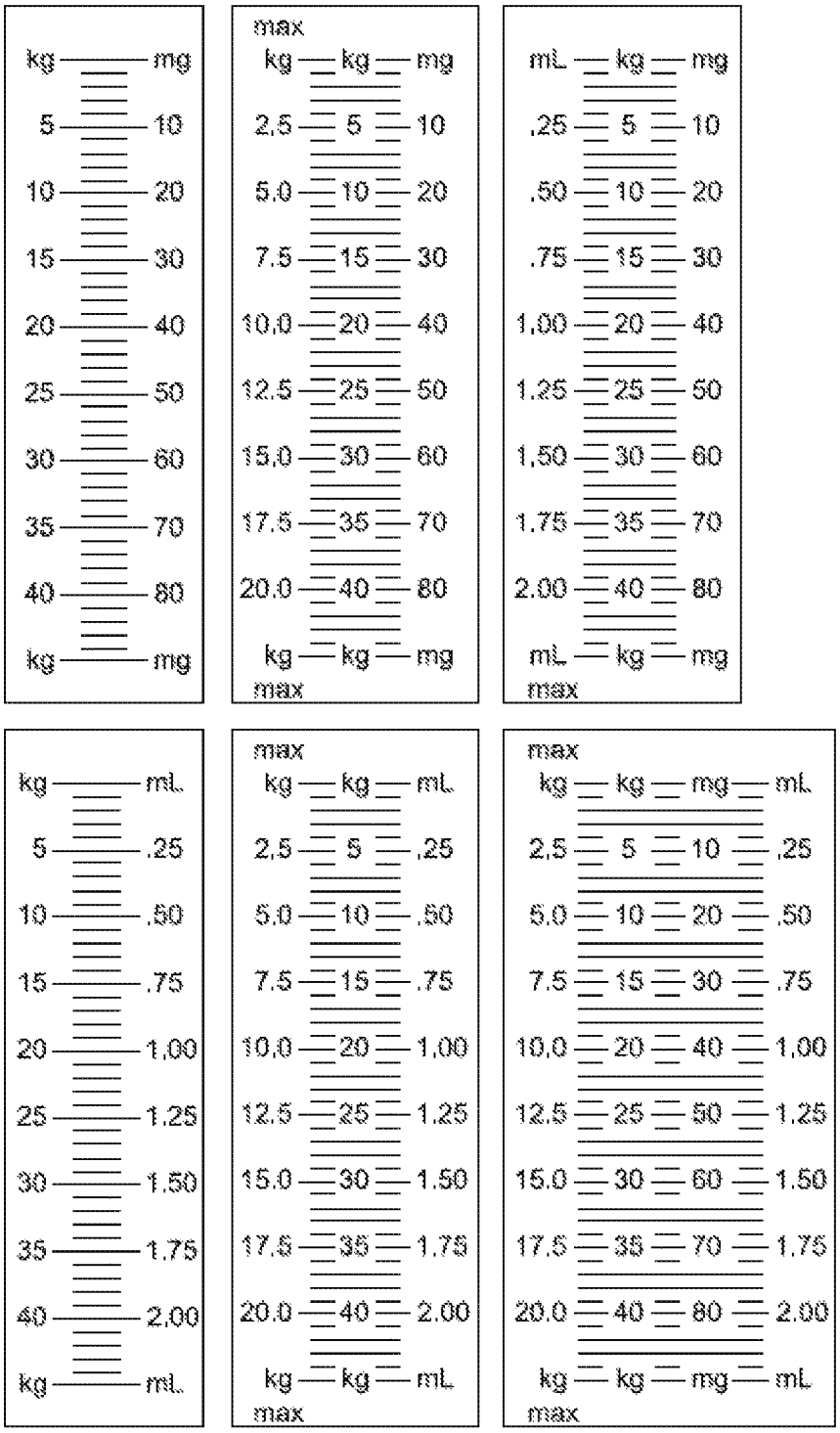
FIGS. 17A-D shown examples of dosage markings for embodiments of delivery devices of the present invention.
Figure 17B:
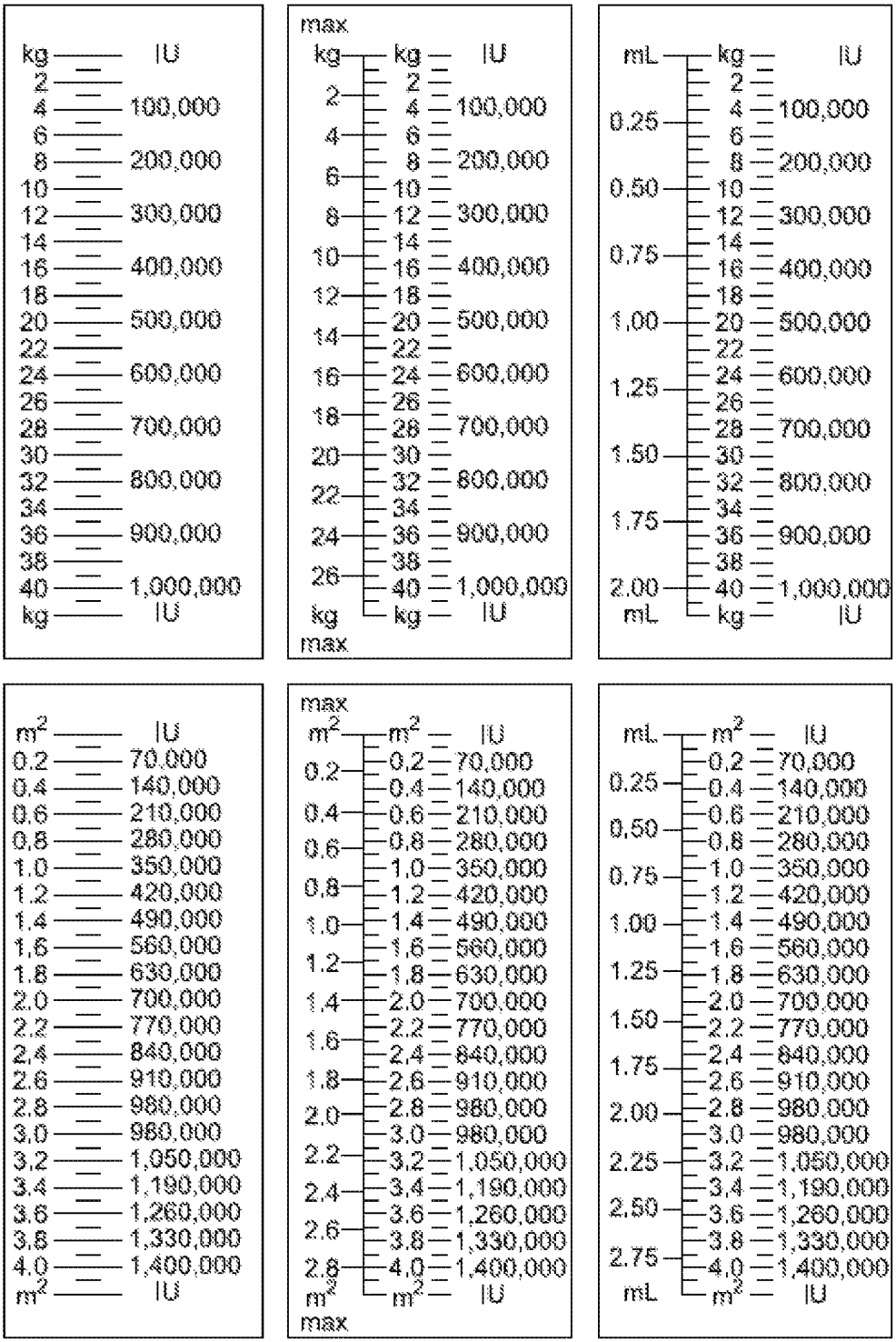
Figure 17C:
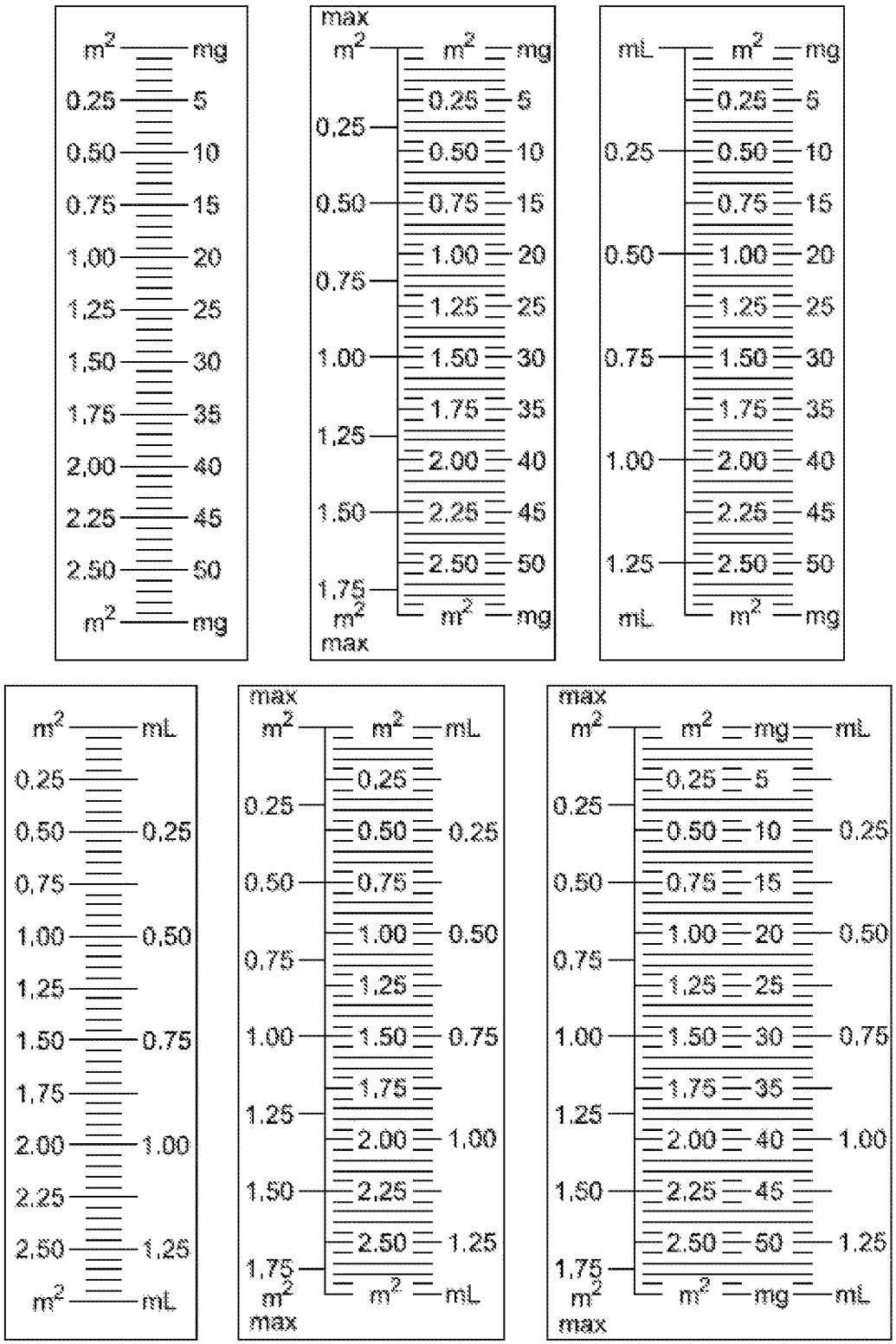
Figure 17D:
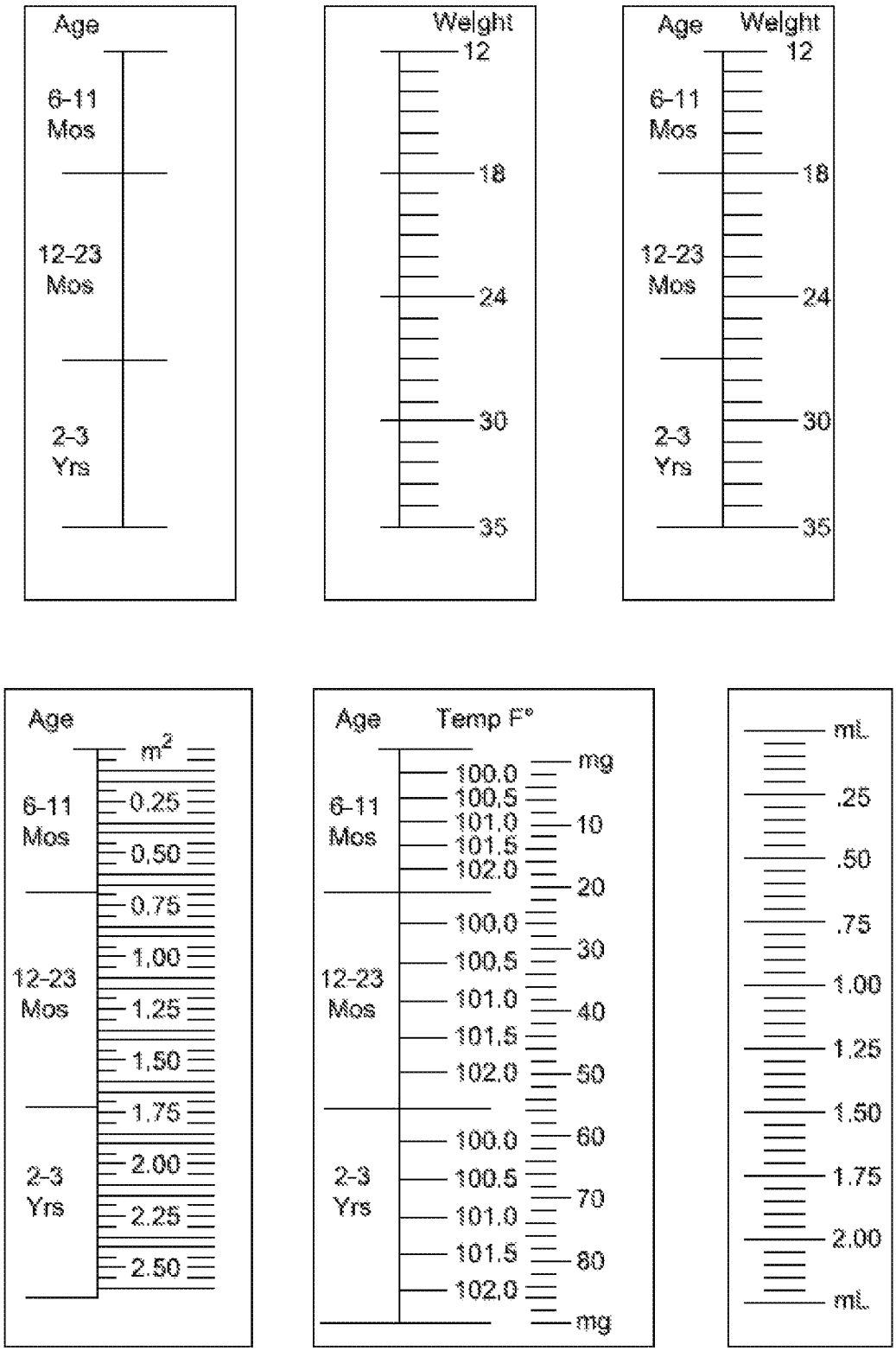

FIGS. 16A-C show the delivery device 104 marked with non-limiting examples of dosing indicia, which may or may not be graduated indicia. FIG. 16A, for example, shows indicia for dosing according to volume and predetermined patient characteristic. FIG. 16B, for example, shows indicia for dosing according to two different patient characteristics (e.g. weight and age). FIG. 16C, for example, shows indicia for dosing according to volume and weight, and one embodiment of a delivery device including an open-ended spoon. In use, the delivery device may be filled with liquid medication in a first orientation of the spoon, and when filled with the appropriate amount, the orientation of the spoon changed to administer the dose (e.g., pour the medication). In this particular embodiment, rotation or other movement of the delivery device with respect to the container may be unnecessary. In some embodiments, the spoon may be attached to the container during filling and removable from the container after filling for administration.

FIGS. 17A-D show non-limiting examples of dosing indicia for marking the delivery device for dosing the predetermined medication to according to a manufacturer's recommended dosage provided on the container, pamphlet accompanying the apparatus, or elsewhere. Non-limiting examples of dosing indicia, which can be provided in any number and/or combination, include mL, mg, mcg, IU, $m^2$, age, weight, temperature, or a maximum or a minimum of any one of mL, mg, mcg, IU, $m^2$, age, weight and temperature.

Figure 18:
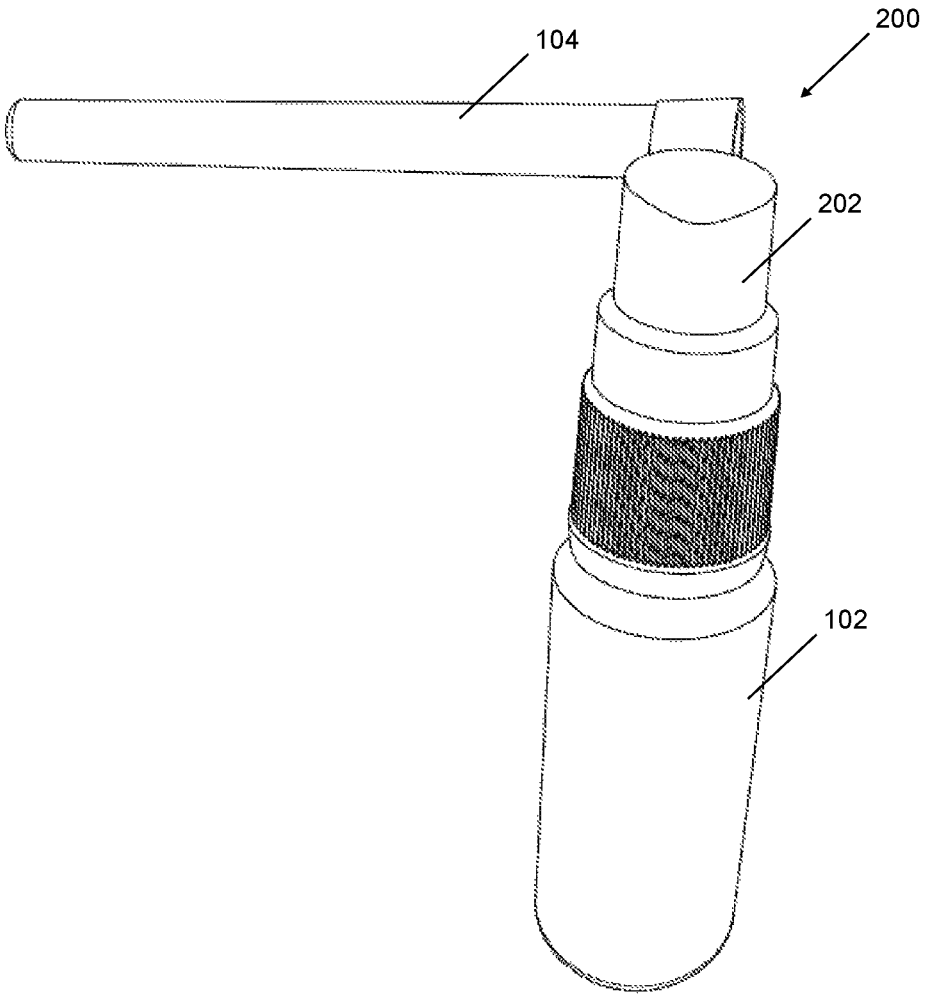
FIG. 18 is a perspective view of a medication delivery apparatus including a pump sprayer.
Figure 19:
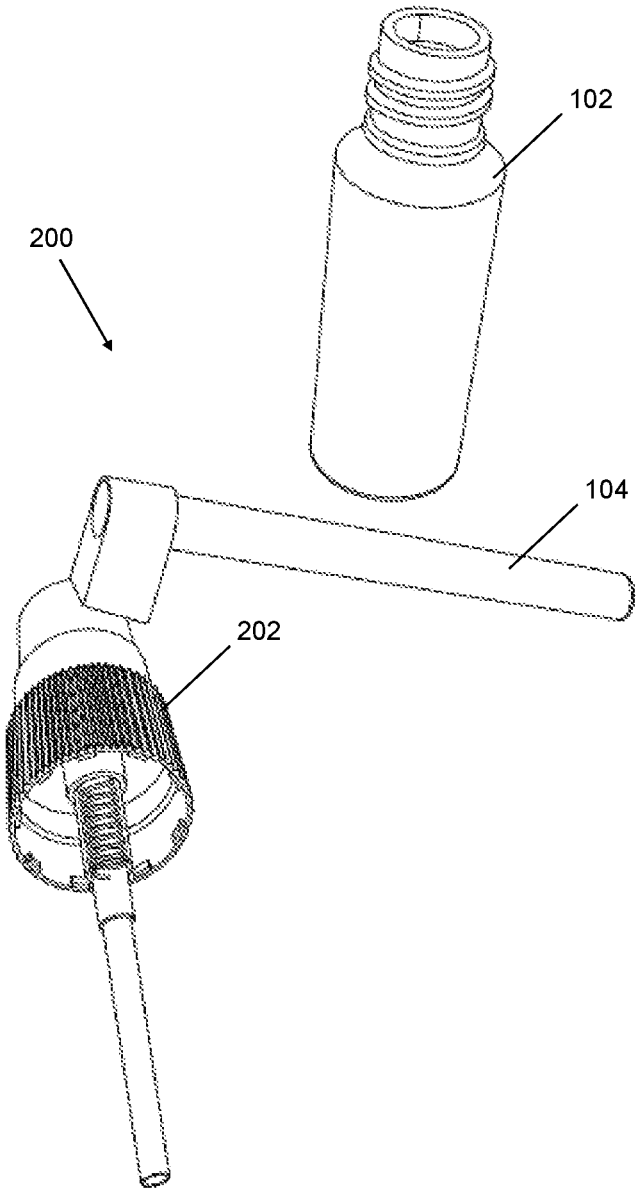
FIG. 19 shows apparatus of FIG. 18 with the pump sprayer detached from the container.

FIGS. 18 and 19 show an alternative embodiment of a medication delivery apparatus at 200. All else being equal to the apparatus 100 in terms of the functionality of the container 102 and attached delivery device 104, the apparatus 200 further includes a pump sprayer 202 for filling the delivery device such as for metered dosing. In some embodiments, the pump sprayer 202 may be a self-venting spray nozzle configured to direct liquid medication through the fluid passageway when the container 102 is inverted and air through the fluid passageway when the container 102 is upright.

In each of the embodiments disclosed herein, the delivery device 104 may be provided in the form including, but not limited to, a syringe, a spoon, a barrel, a pipette, a dropper or a cup.

Indicia marked on any of the container and the delivery device may include at least one of medication name, patient type, oral suspension, brand name of the medication, ingredients, flavor, volume and dosage. Dosages may be expressed in any unit, with or without graduated markings, and in discrete amounts or expressed as ranges.

The embodiments disclosed herein provide an integrated medication delivery apparatus. The apparatus includes active and passive safety features to enable enhanced convenience, safety and accuracy during the preparation and administration of liquid medications. The apparatus is configured to deliver the correct predetermined dose of medication to a specific patient characteristic, such as weight, body surface area (BSA), body mass index (BMI), age, temperature, or in parallel through a specific drug potency, solely through the integrated medication container and correlated delivery device. The integrated delivery device provides intuitive measurement indicia displaying the correct dosing for a multitude of patient characteristics or other dosing modes or preferences, all without any additional calculations or correlations necessary.

The apparatus allows a user to manually control the amount of liquid medication transferred to the delivery device, and thereafter deliver that measured amount to the patient. Liquid medication may be transferred from the medication container to the delivery device by one or more of compression of the container (e.g. squeezing), pressure, pumping, suction, compressed air or other energy source.

In some embodiments, the delivery device may be detachable from the medication container for cleaning or packaging, and may attach to the container via threads, snap-fit engagement, friction fittings, among other attachment mechanism. In some embodiments, the delivery device and the point of attachment of the delivery device to the container may be keyed to prevent an unpaired delivery device from being used with a medication container. Keying may include a key on the delivery device and keyway on the container, or vice-versa, the key and keyway permitting attachment of only a paired delivery device and in a predetermined orientation.

In some embodiments, the delivery device may be moved, rotated, turned or otherwise positioned while connected to the medication container such that the flow of liquid medication from the medication container is restricted from flowing outside of the medication container.

In some embodiments, the apparatus may further include a dedicated mechanism for opening and closing the fluid passageway, such as a valve, lever, stopcock, etc.

In some embodiments, the apparatus is configured with an adjustable actuator to transfer a predetermined amount of liquid medication from the container to the delivery device, such as a metered dose corresponding to a manufacturer's recommend dose.

In some embodiments, the delivery device may be permanently or removably attached to the container, and the configuration thereof may be changed for filling or dispensing.

The foregoing description provides embodiments of the invention by way of example only.

The invention claimed is:

1. A medication delivery apparatus, comprising:

a container configured to contain liquid medication;

a delivery device rotatably attached and coupled in fluid communication to the container, the delivery device paired for use with the container;

a fluid passageway extending between the container and the delivery device;

a coupling element coupling the delivery device to the container, the coupling element defining at least a portion of the fluid passageway therethrough and having spaced first and second stops, wherein the delivery device is rotationally constrained between the spaced first and second stops, and wherein positioning the delivery device proximal to the first stop positions the delivery device in a first operative position and positioning the delivery device proximal to the second stop positions the delivery device in a second operative position; and the coupling element including a first fluid flow passageway therethrough and a second fluid flow passageway therethrough, wherein the first fluid flow passageway is diametrically larger than the second fluid flow passageway, and wherein the delivery device when aligned with the first fluid flow passageway in the first operative position permits liquid medication flow from the container to the delivery device, and the delivery device when aligned with the second fluid flow passageway in the second operative position permits air to flow from the container to the delivery device to dispense liquid medication from the delivery device;

wherein, in the first operative position of the delivery device with respect to the container liquid medication is transferable from the container to the delivery device through the fluid passageway, and in the second operative position of the delivery device with respect to the container liquid medication is dispensable from the delivery device.

2. The medication delivery apparatus according to claim 1, wherein the delivery device rotates with respect to the container between the first and second operative positions of the delivery device.

3. The medication delivery apparatus according to claim 1, further comprising a child-proof cap removably attached to the container, the child-proof cap rotatable relative to the container between a first position closing the fluid passageway and a second position opening the fluid passageway.

4. The medication delivery apparatus according to claim 1, further comprising a check valve disposed in the fluid passageway permitting liquid medication flow in a direction of the delivery device and preventing liquid medication flow in a direction of the container.

5. The medication delivery apparatus according to claim 1, wherein the first operative position of the delivery device corresponds to an inverted orientation of the container and the second operative position of the delivery device corresponds to an upright orientation of the container.

6. The medication delivery apparatus according to claim 1, wherein at least one of the container and the delivery device is marked with a name of a liquid medication contained in the container, a concentration or potency of the liquid medication contained in the container, and at least one set of dosage indicia for dosing a liquid medication according to a manufacturer's recommended dosage.

7. The medication delivery apparatus according to claim 1, wherein the delivery device is marked with a first set of dosing indicia expressed in a dosage unit of measurement matching a dosage unit of measurement of a concentration of liquid medication in the container, and a second set of dosing indicia expressed as a patient characteristic, and wherein the dosing indicia are expressed as one or more of mL, mg, mcg, IU, $m^2$, age, weight, temperature, or a maximum or a minimum of any one of mL, mg, mcg, IU, $m^2$, age, weight and temperature.

8. The medication delivery apparatus according to claim 1, further comprising a pump sprayer for pumping liquid medication from the container to the delivery device and/or dispensing liquid medication from the delivery device.

9. The medication delivery apparatus according to claim 1, wherein the delivery device is in a form of a syringe, a spoon, a barrel, a pipette, a dropper or a cup.

10. A medication delivery apparatus, comprising:

a container configured to contain liquid medication;

a delivery device removably attached to the container;

a fluid passageway extending between the container and the delivery device; and a coupling element coupling the delivery device to the container, the coupling element defining at least a portion of the fluid passageway therethrough and having spaced first and second stops, the delivery device rotationally constrained between the spaced first and second stops, and wherein positioning the delivery proximal to the first stop positions the delivery device in a first operative position and positioning the delivery device proximal to the second stop positions the delivery device in a second operative position, the coupling element including a first fluid flow passageway therethrough and a second fluid flow passageway therethrough, wherein the first fluid flow passageway is diametrically larger than the second fluid flow passageway, and wherein the delivery device when aligned with the first fluid flow passageway in the first operative position permits the liquid medication to flow from the container to the delivery device, and the delivery device when aligned with the second fluid flow passageway in the second operative position permits air to flow from the container to the delivery device to dispense the liquid medication from the delivery device;

wherein, in the first operative position of the medication delivery apparatus the liquid medication is transferable from the container to the delivery device through the fluid passageway, and in the second operative position of the medication delivery apparatus the liquid medication is dispensable from the delivery device.

11. The medication delivery apparatus according to claim 10, further comprising a child-proof cap removably attached to the container, the child-proof cap rotatable with respect to the container between a first position closing the fluid passageway and a second position opening the fluid passageway.

12. The medication delivery apparatus according to claim 10, further comprising a check valve disposed in the fluid passageway allowing liquid medication flow in a direction of the delivery device and preventing liquid medication from in a direction of the container.

13. The medication delivery apparatus according to claim 10, wherein the first operative position of the medication delivery apparatus corresponds to an inverted orientation of the container and/or a first rotational position of the delivery device, and the second operative position of the medication delivery apparatus corresponds to an upright orientation of the container and/or a second rotational position of the delivery device.

14. The medication delivery apparatus according to claim 10, wherein at least one of the container and the delivery device is marked with a name of the liquid medication contained in the container and a concentration or potency of the liquid medication contained in the container, and wherein the delivery apparatus is marked with at least one set of dosage indicia for dosing the liquid medication according to a manufacturer's recommended dosage.

15. A medication delivery apparatus, comprising:

a container;

a delivery device removably attached to the container;

a fluid passageway extending between the container and the delivery device; and a coupling element coupling the delivery device to the container, the coupling element defining at least a portion of the fluid passageway therethrough and having spaced first and second stops, the delivery device rotationally constrained between the spaced first and second stops, and wherein positioning the delivery proximal to the first stop positions the delivery device in a first operative position and positioning the delivery device proximal to the second stop positions the delivery device in a second operative position, the coupling element including a first fluid flow passageway therethrough and a second fluid flow passageway therethrough, wherein the first fluid flow passageway is diametrically larger than the second fluid flow passageway, and wherein the delivery device when aligned with the first fluid flow passageway in the first operative position permits the liquid medication to flow from the container to the delivery device, and the delivery device when aligned with the second fluid flow passageway in the second operative position permits air to flow from the container to the delivery device to dispense the liquid medication from the delivery device;

wherein, when the delivery device is attached to the container, fluid is transferable from the container to the delivery device through the fluid passageway, and wherein fluid is dispensable from the delivery device when the delivery device is attached to the container or detached from the container.

16. The medication delivery apparatus according to claim 15, wherein at least one of the container and the delivery device is required to be positioned in a first orientation to transfer fluid from the container to the delivery device, and is required to be in a second orientation different from the first to dispense fluid from the delivery device.

17. The medication delivery apparatus according to claim 15, further comprising a cap attached to the container, the cap rotatable relative to the container between a first position closing the fluid passageway and a second position opening the fluid passageway.

* * * * *